US007177536B2

(12) United States Patent
Natsuhara et al.

(10) Patent No.: US 7,177,536 B2
(45) Date of Patent: Feb. 13, 2007

(54) FLUID HEATING HEATER

(75) Inventors: Masuhiro Natsuhara, Itami (JP); Hirohiko Nakata, Itami (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 0 days.

(21) Appl. No.: 10/169,249

(22) PCT Filed: Oct. 19, 2001

(86) PCT No.: PCT/JP01/09230

§ 371 (c)(1),
(2), (4) Date: Jun. 28, 2002

(87) PCT Pub. No.: WO02/39027

PCT Pub. Date: May 16, 2002

(65) Prior Publication Data

US 2003/0044173 A1 Mar. 6, 2003

(30) Foreign Application Priority Data

Nov. 7, 2000 (JP) ..... 2000-338716

(51) Int. Cl.
*F24H 1/10* (2006.01)

(52) U.S. Cl. ..... 392/479; 392/473

(58) Field of Classification Search ..... 392/465, 392/467, 479; 219/543, 553, 552
See application file for complete search history.

(56) References Cited

U.S. PATENT DOCUMENTS 4,177,375 A * 12/1979 Meixner ..... 219/441
4,352,008 A * 9/1982 Hofer et al. ..... 219/540
4,482,801 A * 11/1984 Habata et al. ..... 219/540
5,484,075 A * 1/1996 Kimura et al. ..... 216/27
6,084,221 A * 7/2000 Natsuhara et al. ..... 219/553
6,442,341 B1 * 8/2002 Wu ..... 392/479

FOREIGN PATENT DOCUMENTS

| | | |
|---|---|---|
| JP | 10-160249 | 6/1998 |
| JP | 10-259955 | 9/1998 |
| JP | 11-006651 | 1/1999 |
| JP | 11-43978 | 2/1999 |
| JP | 11-135241 | 5/1999 |
| JP | 11-307233 | 11/1999 |
| JP | 2000-206810 | 7/2000 |

* cited by examiner

OTHER PUBLICATIONS

Translation of JP 11-307233, marked up.*

*Primary Examiner*—Thor Campbell
(74) *Attorney, Agent, or Firm*—McDermott Will & Emery LLP

(57) ABSTRACT

The invention provides a fluid heater in which the efficiency of heat transfer to a fluid is improved, downsizing of the heater itself can be achieved, and the rise time until warm water heated to a necessary temperature is supplied is shortened, which results in reduction of the power consumption. The heater includes a flat ceramic substrate (1) and a beating element formed on one surface of or in the interior of the ceramic substrate (1). The ceramic substrate (1) is made of AlN, etc. or silicon nitride, whose thermal conductivity is 50 W/m·K or more. A zigzag water channel is formed by walls 6, etc., on the fluid-heating surface of the ceramic substrate (1). A plurality of fins 5 are fixed in the water channel. A heat insulating material 8 can be mounted so as to cover a surface excluding the fluid-heating surface of the ceramic substrate (1).

4 Claims, 3 Drawing Sheets

FLUID HEATING HEATER

TECHNICAL FIELD

This invention relates to a fluid heater for heating a fluid, and, more particularly, to a fluid heater suitable for heating cleaning water used for a warm-water cleaning toilet seat.

BACKGROUND ART

Generally, a warm-water cleaning toilet seat jets warm water from a fixed nozzle provided at a rear lower part of the toilet seat and washes a specific part of the human body with the warm water. In the toilet seat, warm water heated to a predetermined temperature is conventionally used to improve the comfort of cleaning.

However, in the conventional warm-water cleaning toilet seat, a method is employed in which water is pre-stored in a water storage tank, is thereafter heated to a predetermined temperature by a sheathed heater or the like, and is kept warm, in order to quickly use warm water for cleaning. Therefore, the drawback of the method is that the water in the water storage tank must continue to be kept warm even while it is not used, and, as a result, the power consumption of the heater is considerably large.

In order to solve this problem, therefore, a method recently employed is such that water is heated and jetted from a nozzle only at a time of cleaning. For example, Japanese-Patent Application Publication No. Hei-11-43978 discloses a warm-water cleaning toilet seat provided with a fluid heater in which a ceramic heater having a heating element disposed on a flat ceramic substrate is used for heating water and a meandering water-channel is formed with a plurality of comb-like ribs on the surface of the ceramic heater.

Since a fluid heater used in recent warm-water cleaning toilet seat heats water during cleaning by the use of a heater provided with a heating element disposed on a flat ceramic substrate as disclosed in the publication, electric power for keeping warm is unnecessary, and power consumption can be greatly reduced in comparison with a conventional type of toilet seat in which warm water is kept warm in a water storage tank.

However, there remains a shortcoming in this type of ceramic heater used in a warm-water cleaning toilet seat, such as the ceramic heater disclosed in Japanese Patent Application Publication No. H11-43978, that is, it does not necessarily have sufficiently high thermal efficiency and has relatively high power consumption. Still another disadvantage is the fact that the ceramic heater is easily damaged by a thermal shock if rise time is shortened to promptly supply warm water that has been heated to a necessary temperature.

DISCLOSURE OF INVENTION

In view of these circumstances, the present invention aims to improve the efficiency of heat transfer from a heater to a fluid and to provide a fluid heater in which the size thereof is reduced and the rise time needed for the supply of warm water heated to a necessary temperature is shortened, which results in low power consumption.

In order to achieve the aim, a fluid heater according to an aspect of the present invention includes a flat ceramic substrate and a heating element provided on a surface of or in the interior of the ceramic substrate, whose thermal conductivity is 50 W/m·K or more. Specifically, the ceramic substrate is aluminum nitride.

A fluid heater according to another aspect of the present invention includes a flat ceramic substrate and a heating element provided on a surface of or in the interior of the ceramic substrate, and this ceramic substrate is silicon nitride.

In these fluid heaters according to the present invention, a surface in which the heating elements of the ceramic substrate are not exposed serves as a fluid-heating surface to be in contact with a fluid. A metallic member for increasing a contact area with the fluid is fixed to the fluid-heating surface of the ceramic substrate. Preferably, the metallic member is composed of copper or aluminum.

Further, in the fluid heaters of the present invention, it is preferable that the metallic member be a plurality of fins. More preferably, in the fluid heaters of the present invention, a water channel that meanders alternately bending is formed in the fluid-heating surface of the ceramic substrate, and a plurality of fins are disposed in the water channel.

In the fluid heaters of the present invention, an insulating layer with which the heating element is covered is formed on a surface of the ceramic substrate. Further, a heat insulating material is provided in such a way as to cover at least a surface excluding the fluid-heating surface of the ceramic substrate.

BEST MODE FOR CARRYING OUT THE INVENTION

According to one aspect of the present invention, the fluid heater of the present invention has a structure in which a heating element is formed on a surface of or in the interior of a flat ceramic substrate, and this ceramic substrate uses ceramics whose thermal conductivity is 50 W/m·K or more.

The use of the ceramic substrate whose thermal conductivity is 50 W/m·K or more makes it possible to accelerate the temperature rise of the substrate and to improve the efficiency of heat transfer to a fluid.

In a heater used in a warm-water cleaning toilet seat, a water temperature before heating is about 0° C. in the coldest case, and a water temperature after heating is about 40° C., for example. When water is instantaneously heated in this way, in the case of a ceramic substrate whose thermal conductivity is low, there is a difficulty in the diffusion of Joule heat generated in the heating element into the substrate. Therefore, the speed of the temperature rise of the substrate is slow, and water cannot be quickly heated. Furthermore, since non-uniformity in temperature occurs in the substrate, much time is needed to achieve a uniform water temperature evenly.

According to the present invention, using a ceramic substrate whose thermal conductivity is 50 W/m·K or more makes it possible to uniformize the temperature of the interior of the ceramic substrate as much as possible. Accordingly, the heat generated by the heating element can be quickly transmitted to the surface of the substrate, whereby the water can be heated evenly, uniformly, efficiently, and quickly. Moreover, using a ceramic substrate having a thermal conductivity of 50 W/m·K or more makes it possible to prevent damage such as breakage that may otherwise be caused to the ceramic substrate itself by a great thermal shock when the temperature of a heater is instantaneously raised.

Aluminum nitride, silicon carbide, etc., can be mentioned as examples of ceramic substrates having a thermal conductivity of 50 W/m·K or more. Aluminum nitride is particularly preferable among them because the thermal conductivity of 100 W/m·K or more can be easily obtained, and a temperature distribution in the substrate can be made more uniform by devising its manufacturing method According to another aspect of the present invention, the fluid heater of the present invention has a structure in which a heating element is formed on a surface of or in the interior of a flat ceramic substrate, and this ceramic substrate is silicon nitride. Silicon nitride is preferable because ceramics itself have high strength, and are very strong against external stress such as a thermal shock though, generally, the thermal conductivity thereof is inferior to that of aluminum nitride.

Figure 1:
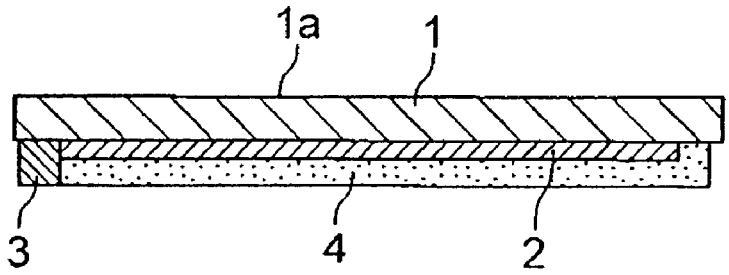
FIG. 1 is a schematic sectional view showing a concrete example of a fluid heater of the present invention.
Figure 5:
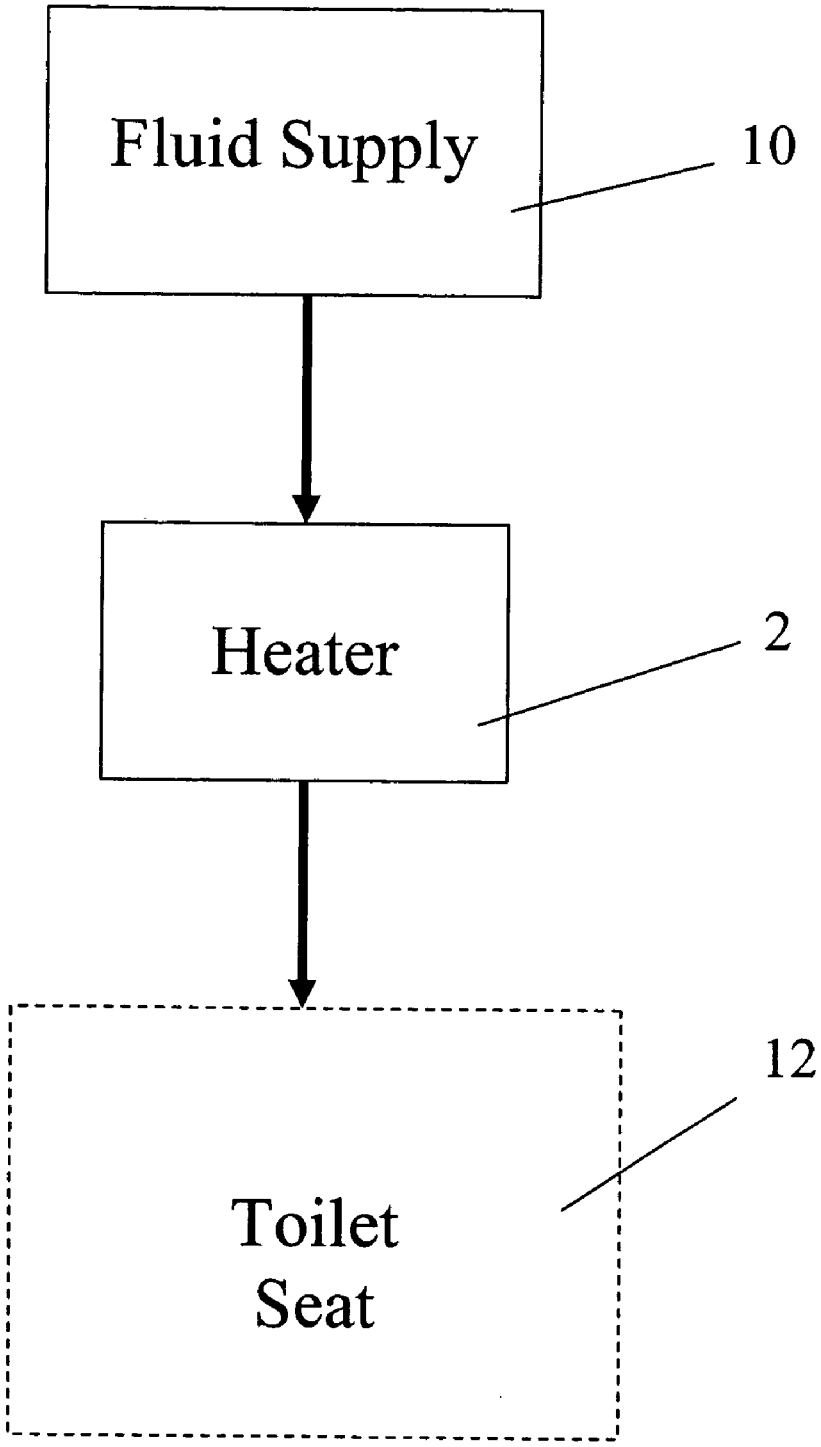
FIG. 5 shows a general relation between a heating element, a water or fluid supply, and a toilet comprising a warm-water cleaning toilet seat in accord with the present concepts.

In the fluid heater of the present invention, a heating element 2 and an electrode 3 for current application are formed on a surface or in the interior of a ceramic substrate 1 as shown in FIG. 1. A surface to which the heating element 2 of the ceramic substrate 1 is not exposed will be designated as a fluid-heating surface 1*a* to be brought into contact with a fluid to be supplied to a warm-water cleaning toilet seat. The general relation between the heating element (e.g., 2), a water or fluid supply 10, and a toilet 12 comprising a warm-water cleaning toilet seat is shown in FIG. 5. As shown in FIG. 1. fluid is supplied to the fluid-heating surface 1*a* of the ceramic substrate 1, and, while the fluid is in contact with the fluid-heating surface 1*a*, the heat of the heating element is transmitted from the fluid-heating surface 1*a* to the fluid so as to heat the fluid prior to output of such heated fluid to a toilet 12 having a warm-water cleaning toilet seat.

Although an insulating layer 4 is usually formed to secure insulation on the heating element 2, it is undesirable to use the insulating layer 4 as a fluid-heating surface because the thermal conductivity of the insulating layer 4 is generally lower than that of the ceramic substrate 1, and the heat generated by the heating element 2 is easily transmitted to the ceramic substrate 1, and, in addition, thermal resistance becomes low. Especially if the thermal conductivity of the ceramic substrate is 50 W/m·K or more, the surface of the ceramic substrate on the side where no insulating layer is formed is used as a fluid-heating surface. If the heating element is formed in the interior of the ceramic substrate without having an insulating layer, one of or both of the surfaces of the ceramic substrate can be used as the fluid-heating surface.

Further, a surface area for heat transfer to a fluid can be increased by fixing a metallic member for increasing a contact area with the fluid onto the fluid-heating surface of the ceramic substrate in order to transmit the heat of the ceramic heater to the fluid more efficiently. Although this metallic member is not limited to a specific shape, it is preferable for the metallic member to have a large surface area, and, generally, to have a shape of a fin such as used for heat radiation. Providing metallic members having a large surface area such as a fin shape described above makes it possible to greatly increase the heating surface area and to heat water more efficiently, since the heat of the heater is transmitted to a plurality of fins, etc.

Also, the heater can be constructed three-dimensionally and the heating surface area can be further increased significantly by forming walls made of metal or resin such that a long alternately meandering zigzag water channel is formed in the fluid-heating surface of the ceramic substrate and by arranging a plurality of fins in the water channel. This is advantageous since it enables reduction in the size of the heater as a whole. If both surfaces of the ceramic substrate are fluid heating surfaces, the metallic member or the fins can also be formed on both the surfaces.

Preferably, the metallic members such as fins and the like are aluminum or copper. Aluminum has a relatively high thermal conductivity of 200 W/m·K, and has the advantage of being easily processed because of its flexibility. Additionally, aluminum has the advantage of being able to reduce the weight of the entire heater unit because of its small specific gravity. Copper is also preferable because it has a thermal conductivity of about 400 W/m·K, and can greatly raise the heat transfer efficiency.

A known technique can be employed as a method for fixing the metallic members onto the ceramic substrate. For example, if the metallic member is copper, it can be bonded with an active-metal solder, or the copper metallic member can be bonded in such a way that the ceramic substrate is metalized with, for example, W (tungsten), and is subjected to the application of a Ni—P plating by which the metallic member is bonded. If the metallic member is aluminum, it can be bonded by using an aluminum solder whose melting point is lower than that of aluminum.

As described above, in the fluid heater of the present invention which is provided with metallic members such as fins, a heating surface area dramatically increases in comparison with a conventional one, and, as a result, the efficiency of heat transfer to a fluid rises greatly, and it becomes possible to obtain the same warm water as before even if the whole of the heater unit including the metallic members is made smaller than a conventional one. In other words, a conventional heater is constructed to perform the heat transmission to a fluid only on a flat ceramic substrate, but, in contrast, the heater of the present invention is constructed to perform the heat transmission to a fluid also from metallic members, such as fins, that have a large surface area, as described above. Therefore, even if the heater and the heater unit are made smaller than conventional ones, a heating surface area that is equal to or is larger than a conventional one can be obtained.

More specifically, in the case where a large number of fins are disposed, the property of obtaining warm water is not affected by reducing the size of the entire heater to about half, depending on the shape of the metallic members. An advantage obtained by such reduction in size is that the cost of the heater can be reduced and another advantage is that the heat capacity of the heater and heater unit can be reduced, whereby power consumption is reduced and the time needed for heating water to a necessary temperature for supply (i.e., rise time of the heater) can be shortened. Therefore, the fluid heater of the present invention is suitable for a water heater used in a warm-water cleaning toilet seat.

Further, in the fluid heater of the present invention, a heat insulating material can be mounted in such a way as to cover at least a surface excluding the fluid-heating surface so as to reduce power consumption and rapidly raise the temperature of the heater by reducing a heat dissipation amount dissipated to the surroundings. More specifically, a heat insulating material, such as ceramic fibers or resins, whose thermal conductivity is low can be mounted in such a way as to wrap a surface excluding the fluid-heating surface of the ceramic substrate. An insulating layer, such as a glass layer, that covers the heating element also has an adiabatic effect, and thermal efficiency can be even more improved by covering the insulating layer with a heat insulating material such as ceramic fibers or resins.

Next, a description will be given of an Example of a manufacturing method of the fluid heater of the present invention. First, aluminum nitride or silicon nitride is prepared as a ceramic substrate. A known method can be used for a manufacturing method of the ceramic substrate made of aluminum nitride or silicon nitride. For example, a specified quantity of a sintering additive is added to a base powder, and a binder and organic solvent are added thereto, and they are mixed together with a ball mill or the like. A resultant slurry is formed into a sheet by the doctor blade method or a similar method, which is thereafter cut in a predetermined size and subsequently subjected to degreasing in a nitrogen or air atmosphere, and is sintered in a non-oxidizing atmosphere, and consequently a ceramic substrate is obtained. Press molding or injection molding can also be used as the molding method.

Subsequently, heating elements are formed on the resultant ceramic substrate. Ag, Pd, Pt, W, Mo, etc., are preferably used as materials of the heating element, but the present invention is not limited to these. These heating elements are formed on the ceramic substrate by patterning by means of a screen printing method or similar method, and then sintering the resultant patterns onto the substrate in a predetermined atmosphere. It is also possible to form W and Mo heating elements by simultaneous baking together with the ceramic substrate.

If necessary, an insulating layer to secure insulation is formed on the heating element. A vitreous material is used generally as a material for the insulating layer, though it is not a limitation. More specifically, a glass powder is transformed into a pasty state by adding a binder and a solvent thereto. The resultant glass paste is formed into a predetermined shape by screen printing, and is baked, whereby an insulating layer is obtained. On the fluid-heating surface (which is opposite to the side having the insulating layer) of the ceramic substrate, metallic members such as fins can also be mounted, as mentioned above.

EXAMPLE 1

Each ceramic substrate of Compositions 1 through 5 that are chiefly composed of ceramics shown in Table 1 given below was manufactured by the following procedures. First, sintering additives were added to respective ceramic base powders at the ratio shown in Table 1, and an organic solvent and a binder were added thereto, and a slurry was formed by mixing them for 24 hours using a ball mill. Thereafter, the slurry was formed into a sheet having a predetermined thickness by a doctor blade method.

Thereafter, each obtained sheet was cut so as to attain the size of 50 mm square after sintering, was thereafter degreased at 800° C. in a nitrogen atmosphere, and was sintered at the temperature shown in Table 1 in a nitrogen atmosphere. Each sintered body that had been obtained was ground to have thickness of 0.635 mm, and was formed into a ceramic substrate. Further, the thermal conductivity of the ceramic substrate was measured according to a laser flash method. The result is also shown in Table 1.

TABLE I

| Composition | Principal component | Sintering additive | Sintering temperature (° C.) | Thermal conductivity (W/mK) |
|---|---|---|---|---|
| 1 | AlN: 96% | $Y_2O_3$: 5% | 1850 | 180 |
| 2 | AlN: 95% | $Yb_2O_3$: 1.8%<br>$Nd_2O_3$: 1.7%<br>CaO: 0.5% | 1700 | 170 |
| 3 | SiC: 95% | $Y_2O_3$: 5% | 1850 | 100 |
| 4 | $Si_3N_4$: 94.5% | $Y_2O_3$: 5%<br>$Al_2O_3$: 0.5% | 1700→<br>1800 X<br>100 Mpa | 35 |
| 5 | $Al_2O_3$: 93% | MgO: 3%<br>$SiO_2$: 2%<br>$CaCO_3$: 2% | 1600 | 20 |

Figure 2:
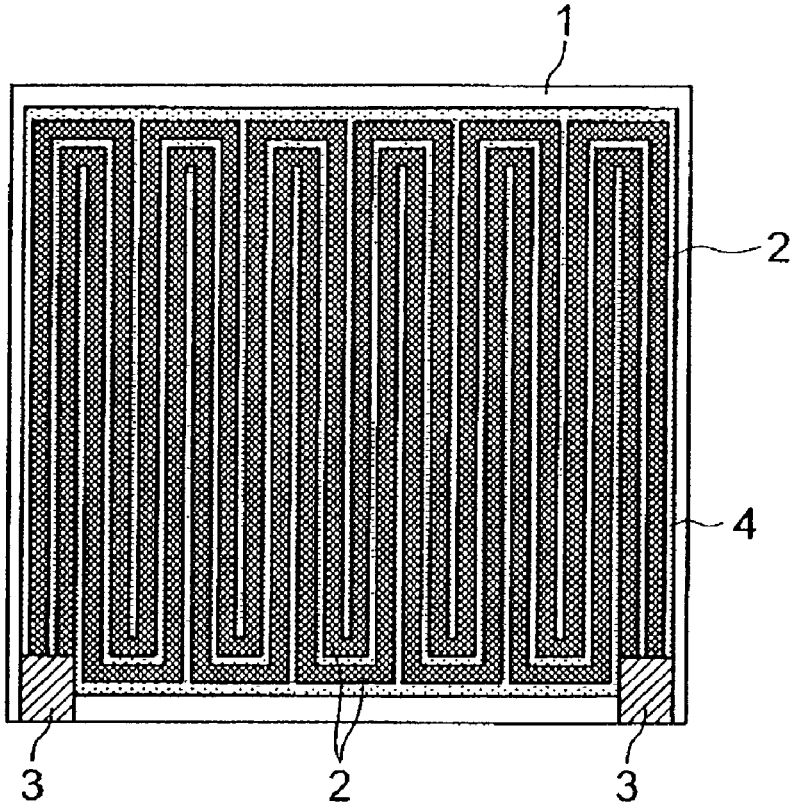
FIG. 2 is a schematic plan view showing a concrete example of a ceramic substrate provided with a heating element in the fluid heater of the present invention.

Ag—Pd paste, which serves as a heating element, and an Ag paste, which serves as an electrode and has a lower sheet-resistance value than the heating element, were applied onto the surface of each ceramic substrate given i Table 1 by screen printing. As shown in FIG. 2, the shapes of heating elements were such that an electrode 3 was disposed at each corner of both ends of the surface of the ceramic substrate 1, and two parallel heating elements 2 were formed between the electrodes 3 in a meandering zigzag manner turning at 180 degrees in the vicinity of both ends of the ceramic substrate 1.

Subsequently, the pastes were burned and baked at 880° C. in the atmosphere, and the heating elements 2 and the electrodes 3 were formed on the ceramic substrate 1. Thereafter, a glass paste whose principal component is $SiO_2$—$B_2O_3$—ZnO was applied onto the heating element 2 by screen printing, and was baked at 700° C. in the atmosphere, and thus an insulating layer 4 was formed.

Thereafter, a water channel was formed by resinous ceilings and walls on the surface (i.e., fluid-heating surface) opposite to the insulating layer 4 of the ceramic substrate 1, and they were mounted as a heater of a warm-water cleaning toilet seat. The power consumption of the heater and the rise time thereof were measured, and an evaluation thereof was made. Measurement was performed under the condition where warm-water jetting time was 30 seconds and a jetting quantity was 180 grams. The setting for a water temperature was such that the water temperature before heating was 20° C., and the water temperature after heating was 37° C. The rise time was determined by measuring the time needed to raise the water temperature to 35° C. from the start of the warm-water jetting. The results thereof are shown in Table II below.

TABLE II

| Ceramic substrate | Composition 1 | Composition 2 | Composition 3 | Composition 4 | Composition 5 |
|---|---|---|---|---|---|
| Rise time (second) | 2.4 | 2.5 | 3.0 | 5.5 | 8.0 |
| Power consumption (Wh) | 4.7 | 4.7 | 4.8 | 5.0 | 5.5 |

From the results, it is understood that a heater that uses a ceramic substrate whose thermal conductivity is high, i.e., a ceramic substrate mainly composed of AlN and SiC is extremely shorter in rise time than other heaters and can reduce power consumption.

EXAMPLE 2

Figure 3:
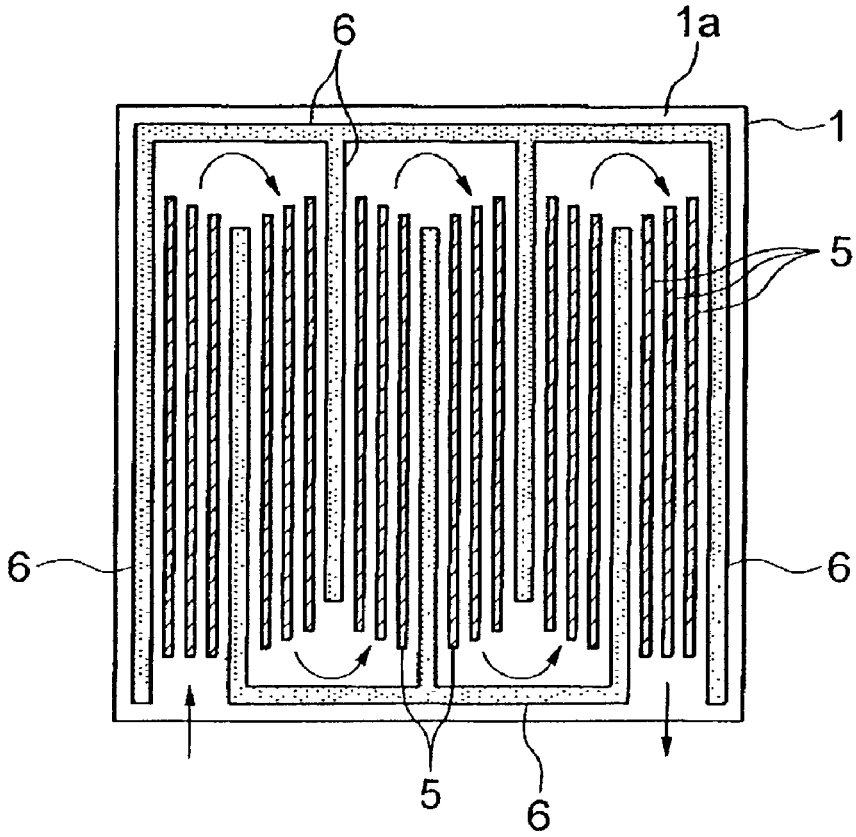
FIG. 3 is a schematic plan view showing a concrete example of a ceramic substrate that is provided with a water channel where fins are disposed on a fluid-heating surface in the fluid heater of the present invention.

Heating elements and electrodes were formed on each of ceramic substrates of the same Compositions 1 through 5 as in Example 1, and subsequently aluminum was applied by vacuum deposition so as to form a layer having a thickness of 3 μm on a fluid-heating surface, on which the heating elements were not formed. The aluminum layer thus formed was partially removed by machining, and, as shown in FIG. 3, a meandering, zigzag water channel alternately turning at 180 degrees was formed by aluminum walls 6 and ceilings (not shown) on the remaining aluminum layer. Thereafter, a plurality of aluminum fins 5 were disposed in the water channel, and were bonded to the aluminum layer respectively by an aluminum-brazing material (0.2 mm in thickness) at 600° C. in a vacuum. Arrows in FIG. 3 denote directions in which the water flows.

Thereafter, a hose was connected so that the water could flow in the water channel where the fins 5 were disposed, and these were mounted as a heater of a warm-water cleaning toilet seat. The power consumption and the rise time of the heater were measured under the same conditions as in Example 1. The results are shown in Table 3 below. From the results, it is understood that the rise time of the heater becomes even shorter than in Example 1 because the heating surface area to the water is increased by providing the aluminum fins.

TABLE III

| Ceramic substrate | Composition 1 | Composition 2 | Composition 3 | Composition 4 | Composition 5 |
|---|---|---|---|---|---|
| Rise time (second) | 2.0 | 2.0 | 2.5 | 4.7 | 7.1 |
| Power consumption (Wh) | 5.2 | 5.2 | 5.4 | 5.6 | 6.1 |

EXAMPLE 3

W-paste heating elements and W-paste electrodes were applied in the shapes shown in FIG. 2 by screen printing onto sheet-like molded ceramic bodies that had the same Compositions 1 through 5 as in Example 1. Further, a W paste was also applied by screen printing onto the whole of the surface having no heating elements, and these were subjected to simultaneous sintering under the same conditions as in Example 1. The same glass paste as in Example 1 was applied by screen printing onto the W heating elements of each ceramic substrate that had been obtained, and subsequently baked in a nitrogen atmosphere so that the W heating elements might not be oxidized, whereby an insulating layer was formed.

Thereafter, a Ni—P plating was formed in a thickness of 2 μm on the whole of the fluid-heating surface, which is the opposite side relative to the electrodes and W heating elements, of each ceramic substrate. A water channel shaped as shown in FIG. 3 was formed on the plated surface of the fluid-heating surface, and copper fins were disposed in the water channel in the same way as in Example 2, and they were bonded to the plated surface at 900° C. in a nitrogen atmosphere.

Thereafter, a hose was connected so that water could flow in the water channel where the copper fins were disposed, and these were mounted as a heater of a warm-water cleaning toilet seat. The power consumption and the rise time of the heater were measured under the same conditions as in Example 1. The results are shown in Table 4 below. From the results, it is understood that, in the case where the copper-made fins are provided, the rise time of the heater becomes shorter though the power consumption slightly rises in comparison with Example 1.

TABLE IV

| Ceramic substrate | Composition 1 | Composition 2 | Composition 3 | Composition 4 | Composition 5 |
|---|---|---|---|---|---|
| Rise time (second) | 1.7 | 1.7 | 2.3 | 4.5 | 6.8 |
| Power consumption (Wh) | 5.4 | 5.4 | 5.6 | 5.8 | 6.4 |

EXAMPLE 4

Sheets having the same Compositions 1 through 5 as in Example 1 were formed to have a thickness of 0.318 mm after sintering, which is half as compared with the thickness in Example 1. Thereafter, heating elements and electrodes were formed by screen printing, applying a W-paste onto one surface of the sheet-like ceramic molded bodies in the same way as in Example 3. Further, the surface on which the W paste was screen printed as described above was laminated with a sheet having the same compositions and the same thickness as the above-mentioned sheet-like ceramic molded body and having cut parts through which the electrodes were to be exposed, and the whole thereof was simultaneously sintered. Thereafter, aluminum was deposited by vapor deposition on both surfaces of each of the ceramic substrates thus obtained that includes the heating elements, and a water channel was formed thereon in the same way as in Example 2.

Subsequently, a plurality of aluminum fins were disposed in each water channel. Thus, heaters in which both surfaces were fluid-heating surfaces having a water channel including aluminum fins were respectively fabricated.

Thereafter, a hose was connected so that the water could flow in the water channel where the fins were disposed, and these heaters were mounted on a warm-water cleaning toilet seat. The power consumption and the rise time of the heater were measured under the same conditions as in Example 1. The results are shown in Table 5 below. As can be seen from the results, the rise time of the heaters became even shorter than in Example 1 and Example 3 because a heating surface area to the water was increased by providing both surfaces with a water channel including aluminum fins respectively.

TABLE V

| Ceramic substrate | Composition 1 | Composition 2 | Composition 3 | Composition 4 | Composition 5 |
|---|---|---|---|---|---|
| Rise time (second) | 1.5 | 1.6 | 2.1 | 4.1 | 6.5 |
| Power consumption (Wh) | 6.3 | 6.4 | 6.7 | 6.9 | 7.4 |

EXAMPLE 5

Sheets having the same compositions and the same thickness (0.318 mm after sintering) as in Example 4 were formed, and ceramic heaters that were provided with W heating elements contained inside were fabricated in the same way as in Example 4. The shape of the heaters is designated as shape A. On the other hand, the ceramic heaters having a vitreous insulating layer on one surface, which were used in Example 1, were simultaneously prepared. The shape of the heaters is designated as shape B.

Thereafter, a zigzag water channel was formed as shown in FIG. 3 and a plurality of aluminum fins 5 were provided therein on a fluid-heating surface of each of the shape A and shape B ceramic heaters in the same way as in Example 2. In the shape A heaters provided with the heating elements contained inside, only one of the exposed surfaces of the ceramic substrate was used as a fluid-heating surface, and the water channel and fins were disposed only on this surface.

Figure 4:
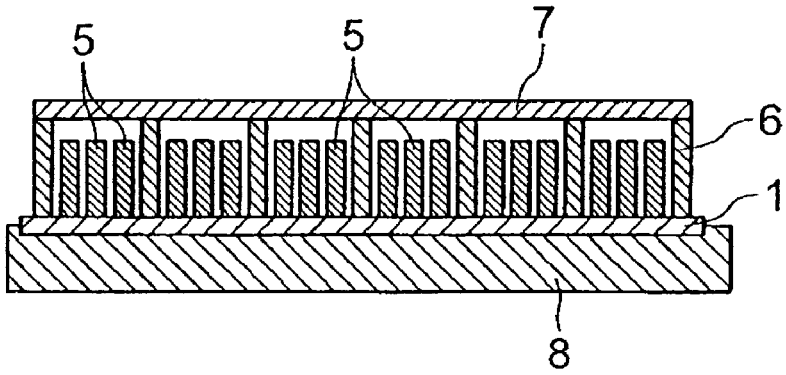
FIG. 4 is a schematic sectional view showing a concrete example of a ceramic substrate whose fluid-heating surface is provided with a water channel where fins are disposed and whose other side is provided with a heat insulating material, in the fluid heater of the present invention.

Further, the surface (i.e., the exposed ceramic surface in shape A, and the insulating layer in shape B, respectively) that is opposite to the fluid-heating surface of the ceramic substrate 1 on which the fins 5 were provided was covered with a heat insulating material 8 made of ceramic fibers or resins, as shown in FIG. 4. ABS resin having heat resistance was used in this Example. In FIG. 4, reference numeral 6 designates a wall, and 7 a ceiling, respectively made of aluminum.

Thereafter, a hose was connected so that the water could flow in the water channel where the fins were disposed, and the heaters thus made were mounted on warm-water cleaning toilet seats. The power consumption and the rise time of the heater were measured under the same conditions as in Example 1. The results are shown in Table VI through Table X, which are grouped in terms of the composition of the ceramic substrate.

TABLE VI

| Ceramic substrate: Composition 1 | | | | | | |
|---|---|---|---|---|---|---|
| Ceramic substrate | Shape A | Shape A | Shape A | Shape B | Shape B | Shape B |
| Heat insulating material | None | Resin | Ceramics | None | Resin | Ceramics |
| Rise time (second) | 2.3 | 2.0 | 1.8 | 2.0 | 1.8 | 1.7 |
| Power consumption (Wh) | 6.1 | 5.8 | 5.4 | 5.2 | 5.0 | 4.8 |

TABLE VII

| Ceramic substrate: Composition 2 | | | | | | |
|---|---|---|---|---|---|---|
| Ceramic substrate | Shape A | Shape A | Shape A | Shape B | Shape B | Shape B |
| Heat insulating material | None | Resin | Ceramics | None | Resin | Ceramics |
| Rise time (second) | 2.4 | 2.0 | 1.8 | 2.0 | 1.8 | 1.7 |
| Power consumption (Wh) | 6.1 | 5.8 | 5.4 | 5.2 | 5.0 | 4.8 |

TABLE VIII

| Ceramic substrate: Composition 3 | | | | | | |
|---|---|---|---|---|---|---|
| Ceramic substrate | Shape A | Shape A | Shape A | Shape B | Shape B | Shape B |
| Heat insulating material | None | Resin | Ceramics | None | Resin | Ceramics |
| Rise time (second) | 2.9 | 2.6 | 2.4 | 2.5 | 2.3 | 2.1 |
| Power consumption (Wh) | 6.5 | 6.1 | 5.6 | 5.4 | 5.2 | 5.0 |

TABLE IX

| Ceramic substrate: Composition 4 | | | | | | |
|---|---|---|---|---|---|---|
| Ceramic substrate | Shape A | Shape A | Shape A | Shape B | Shape B | Shape B |
| Heat insulating material | None | Resin | Ceramics | None | Resin | Ceramics |
| Rise time (second) | 5.5 | 5.0 | 4.6 | 4.7 | 4.4 | 4.1 |
| Power consumption (Wh) | 6.8 | 6.3 | 5.8 | 5.6 | 5.4 | 5.2 |

TABLE X

| Ceramic substrate: Composition 5 | | | | | | |
|---|---|---|---|---|---|---|
| Ceramic substrate | Shape A | Shape A | Shape A | Shape B | Shape B | Shape B |
| Heat insulating material | None | Resin | Ceramics | None | Resin | Ceramics |
| Rise time (second) | 8.4 | 7.7 | 6.9 | 7.1 | 6.6 | 6.3 |
| Power consumption (Wh) | 7.5 | 6.9 | 6.5 | 6.1 | 5.8 | 5.5 |

From the results, it is understood that disposing the heat insulating material on the surface of the ceramic substrate which is opposite to the fluid-heating surface makes it possible to further shorten the rise time of the heater, and to reduce the power consumption, and thus to improve the thermal efficiency of the heater.

EXAMPLE 6

Each sintered body formed in Example 1 was cut in the size of 25 mm×50 mm by dicing, and heating elements were formed on the resulting ceramic substrate in the same way as in Example 1. Subsequently, a water channel in which fins were disposed was provided on a fluid-heating surface in the same way as in Example 2, and thus heaters were formed. The size of the fin and that of the water channel were reduced to half the sizes employed in Example 2, respectively in accordance with the ceramic substrates.

Thereafter, a hose was connected so that the water could flow in the water channel where the fins were disposed, and the heaters thus made were mounted on warm-water cleaning toilet seats. The power consumption and the rise time of the heater were measured under the same conditions as in Example 1. The results are shown in Table 11 below. As can be understood from the results, performance which is equal to that in Example 2 or which is greater than in Example 2 was obtained in spite of the fact that the size of the entire heater was reduced to be half.

TABLE XI

| Ceramic substrate | Composition 1 | Composition 2 | Composition 3 | Composition 4 | Composition 5 |
|---|---|---|---|---|---|
| Rise time (second) | 1.6 | 1.6 | 2.1 | 4.4 | 6.9 |
| Power consumption (Wh) | 4.4 | 4.4 | 4.6 | 4.9 | 5.4 |

Comparative Example 1

Heaters were formed in the same way as in Example 2 except that fins having the same shape as in Example 2 but made of materials different from those in Example 2 were fixed with a thermo-conductive adhesive. The heaters thus obtained were evaluated in the same way as in Example 1, and the results are shown in Table XII through Table XIV, which are grouped in terms of the material of the fins.

TABLE XII

| Fin material: SUS | | | | | |
|---|---|---|---|---|---|
| Ceramic substrate | Composition 1 | Composition 2 | Composition 3 | Composition 4 | Composition 5 |
| Rise time (second) | 2.3 | 2.4 | 2.9 | 5.4 | 7.9 |
| Power consumption (Wh) | 5.8 | 5.9 | 6.1 | 6.4 | 7.8 |

TABLE XIII

| Fin material: alumina | | | | | |
|---|---|---|---|---|---|
| Ceramic substrate | Composition 1 | Composition 2 | Composition 3 | Composition 4 | Composition 5 |
| Rise time (second) | 6.5 | 6.7 | 6.9 | 8.2 | 11.4 |
| Power consumption (Wh) | 7.2 | 7.3 | 7.5 | 7.7 | 8.9 |

TABLE XIV

| Fin material: resin | | | | | |
|---|---|---|---|---|---|
| Ceramic substrate | Composition 1 | Composition 2 | Composition 3 | Composition 4 | Composition 5 |
| Rise time (second) | 10.5 | 10.6 | 10.8 | 12.1 | 13.0 |
| Power consumption (Wh) | 7.5 | 7.6 | 7.5 | 8.0 | 9.1 |

From the results, it is understood that the heaters provided with the SUS fins are lower in heat transfer efficiency and are inferior both in rise time and in power consumption than the heaters provided with the aluminum or copper fins because the thermal conductivity of SUS is low, though the heaters provided with the SUS fins are faster in rise speed than the heaters having no fins in Example 1. The heater provided with the aluminum-made or resin-made fins is very much deteriorated both in rise time and in power consumption because its thermal conductivity is low.

Comparative Example 2

Heaters provided with aluminum-made fins were formed in the same way as in Example 2. In this Example, the fins were mounted on an insulating layer that had been formed in such a way as to cover heating elements on the ceramic substrate, and this surface was used as a fluid-heating surface. An evaluation of each obtained heater was made as in Example 1. The results are shown in Table 15 below.

TABLE XV

| Ceramic substrate | Composition 1 | Composition 2 | Composition 3 | Composition 4 | Composition 5 |
|---|---|---|---|---|---|
| Rise time (second) | 2.5 | 2.5 | 2.7 | 4.7 | 7.2 |
| Power consumption (Wh) | 5.7 | 5.6 | 5.8 | 5.9 | 6.2 |

As can be seen from the results, the higher the thermal conductivity of a ceramic substrate provided in the heaters, the more deteriorated both in rise time and in power consumption of the heaters as compared with Example 2. Presumably, the reason is that the thermal resistance from the heating element to the surface of the insulating layer is larger than the thermal resistance from the heating element to the surface on the other side of the ceramic substrate.

INDUSTRIAL APPLICABILITY

According to the present invention, heat transfer efficiency from the heater to the fluid is improved, and, as a result, the rise time until warm water heated to a necessary temperature is supplied can be shortened, and power consumption is reduced, and the heater can be made small in size. Therefore, a fluid heater can be provided which is suitable especially as a water heater of a warm-water cleaning toilet seat.

The invention claimed is:

1. A fluid heater for heating a fluid, comprising a substantially flat ceramic substrate and a heating element formed on a surface of or in an interior of the ceramic substrate, the ceramic substrate having thermal conductivity of 50 W/m·K or more, wherein a surface from which the heating element of the ceramic substrate is not exposed serves as a fluid-heating surface in contact with the fluid, wherein a metallic member for increasing a contact area with the fluid is fixed to the fluid-heating surface of the ceramic substrate, and a water channel that meanders alternately turning is formed on the fluid-heating surface of the ceramic substrate, and a plurality of fins are disposed in the water channel in alignment with a direction of the water channel.

2. The fluid heater of claim 1, wherein the metallic member is made of copper or aluminum.

3. The fluid heater of claim 1, wherein the metallic member is a plurality of fins.

4. The fluid heater of claim 2, wherein the metallic member is a plurality of fins.

* * * * *